United States Patent [19]

Takezawa

[11] 4,426,635

[45] Jan. 17, 1984

[54] VARIABLE RESISTOR

[75] Inventor: Keiji Takezawa, Miyagi, Japan

[73] Assignee: Alps Electric Co., Ltd., Tokyo, Japan

[21] Appl. No.: 301,206

[22] Filed: Sep. 11, 1981

[30] Foreign Application Priority Data

Sep. 13, 1980 [JP] Japan ..... 55-130830

[51] Int. Cl.[3] ..... H01C 10/44

[52] U.S. Cl. ..... 338/183; 338/176

[58] Field of Search ..... 338/160, 161, 165, 176, 338/180, 183, 188

[56] References Cited

U.S. PATENT DOCUMENTS

| | | | |
|---|---|---|---|
| 2,871,328 | 1/1959 | Budd et al. | 338/183 |
| 2,999,994 | 9/1961 | Bourns et al. | 338/183 X |
| 3,307,133 | 2/1967 | Wolff | 338/183 X |
| 3,343,115 | 9/1967 | Greenwood | 338/202 X |
| 3,982,221 | 9/1976 | Smith | 338/160 X |
| 4,213,112 | 7/1980 | Alman et l. | 338/183 X |
| 4,357,592 | 11/1982 | Okuya | 338/183 X |

*Primary Examiner*—C. L. Albritton

*Attorney, Agent, or Firm*—Guy W. Shoup; Gerard F. Dunne

[57] ABSTRACT

A variable resistor improved to eliminate noise generated in the slider due to a voltage drift attributable to a contact resistance. The variable resistor has an insulting substrate, a resistance member formed on the insulating substrate and connected to a first and a third terminals, a collector formed on the insulating substrate in parallel with the resistance member and connected at its one end to a second electrode, a conductor formed also on the insulating substrate and extending in parallel with the resistance member substantially over the entire length of the resistance member from the electrode connected to one end of the resistance member, and a first and a second slider carried by a common slider carrier, the first slider having contacts adapted for sliding on the resistance member and the conductor, while the second slider having contacts for sliding on the resistance member and the collector at the same position as the contacts of the first slider along the length of the resistance member.

5 Claims, 3 Drawing Figures

VARIABLE RESISTOR

BACKGROUND OF THE INVENTION

The present invention relates to a variable resistor and, more particularly, to a variable resistor which is improved to minimize the noise caused by contact resistance generated by the slider which slides on a stationary resistance member.

As will be described later with reference to the drawings, conventional variable resistors have suffered a problem of noise due to a drift of voltage attributable to the contact resistance.

Although various attempts and proposals have been made to eliminate this noise, none of these attempts and proposals resolved the problem of noise to a satisfactory extent.

SUMMARY OF THE INVENTION

Accordingly, an object of the invention is to provide a variable resistor in which the noise generated in the slider due to the contact resistance is diminished.

To this end, according to the invention, there is provided a variable resistor comprising an insulating substrate; a resistance member formed on the insulating substrate and connected at its both ends to first and third terminals through respective leads; a collector formed on the insulating substrate in parallel with the resistance member and connected at its one end to a second terminal; a conductor formed on the insulating substrate to extend in parallel with the resistance member over the entire length of the latter from the electrode of one end of the resistance member; and a first slider and a second slider carried by a common slider carrier. The first slider is adapted to slide on the resistance member and the conductor, while the second slider is adapted to slide on the resistance member and the collector at the same position along the length of the resistance member as the first slider. In this way, the amount of current flowing through the second slider can be reduced to minimize output noise.

The above and other objects, as well as advantageous features of the invention will become clear from the following description of the preferred embodiment taken in conjunction with the accompanying drawings.

DESCRIPTION OF THE PREFERRED EMBODIMENT

Before turning to the detailed description of the preferred embodiment, an explanation will be made hereinunder as to a problem of the prior art, for a full understanding of the drawbacks of the prior art and, hence, the advantages of the invention.

Figure 1:
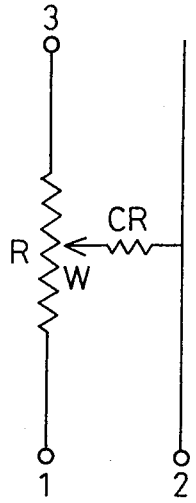
Fig. 1 PRIOR ART
FIG. 1 is a circuit diagram of an example of conventional variable resistors.

Referring to FIG. 1 showing an example of the electric circuits of conventional variable resistors, electric current is made to flow in the resistance member R connected between a first and a third terminal, and a slider W connected to a second terminal is made to slide on this resistance member R, so that a variable resistance can be obtained through the second terminal. In this type of variable resistor, a voltage drift is caused in the slider from which the voltage is derived, due to the contact resistance, to undesirably generate considerable levels of noise.

Various countermeasures such as use of a multiplicity of slider contacts have been proposed, but all of these countermeasures could not provide sufficient solution to this problem.

The mechanism of generation of the noise will be described hereinunder more fully. The voltage $V_1$ generated at the third terminal when electric current $i_1$ flows in the third terminal is represented by $V_1=R\times i_1+CR\times i_1$. Assume here a voltage drift $\Delta CR$ caused by the contact resistance CR. The voltage $V_1$ is then expressed as follows:

$$V_1=R\times i_1+CR\times i_1+\Delta CR\times i_1=R\times i_1+(CR+\Delta CR)i_1$$

The second terminal picks up this voltage drift $\Delta CR$ and the picked up voltage drift appears as noise. Therefore, it is understood that the noise can be eliminated by arranging such that only the component of product of resistance and current in the form of $V_2=R\times i_1$ is picked up while the components involving the factors of contact resistance CR and voltage drift $\Delta VR$ are neglected.

Figure 3:
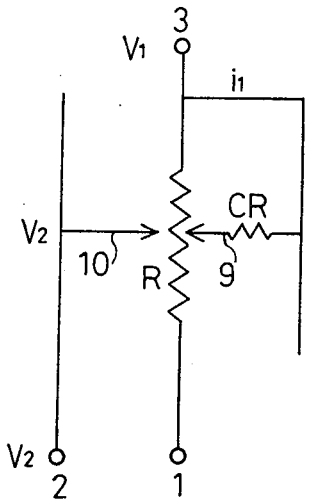
FIG. 3 is a circuit diagram of the variable resistor shown in FIG. 2.
Figure 2:
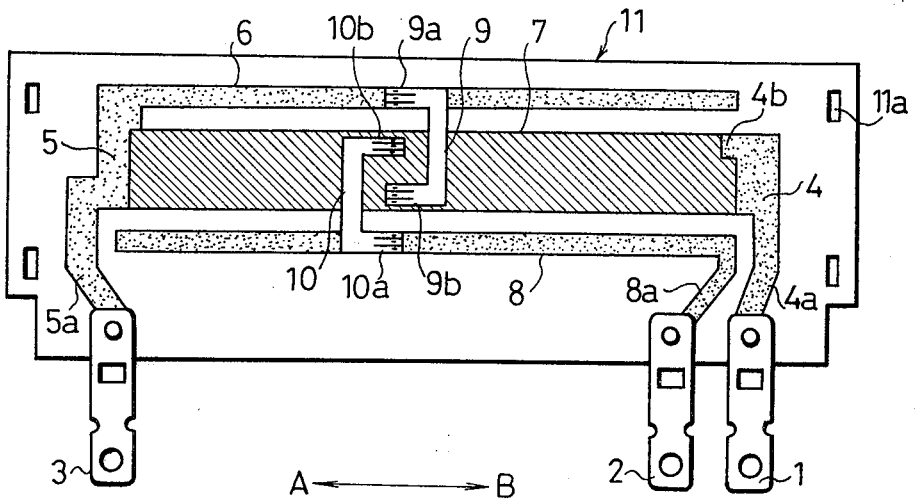
FIG. 2 is a plan view of an insulating substrate on which parts of variable resistors of the invention are formed.

The present invention is to provide a variable resistor in which the resistance circuit pattern and the sliding operation of the slider are improved to realize the above-explained idea for eliminating the noise, as will be understood from the following description of the preferred embodiments taken in conjunction with FIGS. 2 and 3.

Referring to these Figures, a reference numeral 11 designates an insulating substrate to which are attached first to third terminals 1,2 and 3. Terminal electrodes 4,5 made of silver film are connected at their one ends to the first and third terminals through leads *4a*,*5a*, while other ends are connected to respective ends of a resistance member 7 formed on the insulating substrate 1. A conductor 6 is formed also on the insulating substrate 1 to extend from one terminal electrode 5 over the entire length of the resistance member 7 in parallel with the latter. A collector 8 is formed also on the insulating substrate 1 to extend over the entire length of the resistance member 7 and connected at its one end to the second terminal through a lead *8a*. A reference numeral 9 designates a first slider having a plurality of contacts *9a*,*9b*, while 10 designates a second slider having a plurality of contacts *10a*,*10b*. These sliders are carried by a slider carrier (not shown) in a manner known per se. The insulating substrate 1 is adapted to be secured to a suitable member at its apertures *11a*.

In the illustrated embodiment, reference numerals 3,2 and 1 correspond, respectively, to the third, second and first terminals. For obtaining variable resistance, electric current is supplied to flow between the third and the first terminal, and the sliders 9,10 are made to slide as a unit in such a manner that the contacts *9b*,*10b* take the same position on the reference member 7 along the length of the latter, in the resistance shown by arrows A-B, so that variable resistance is derived from the slider 10. FIG. 3 shows a circuit corresponding to the arrangement shown in FIG. 2. As electric current $i_1$ is supplied to flow between the third and the first terminals, the electric current $i_1$ reaches the first terminal 1 through the electrode 5, conductor 6, slider 9 and the resistance member 7. Therefore, the maximum resistance is obtained when the sliders 9 and 10 are positioned at the end adjacent to the third terminal 3, and the resistance value is progressively decreased as the sliders are moved toward the end adjacent to the first terminal 1. Thus, the minimum resistance value is obtained when the sliders 9,10 are positioned at the end adjacent to the first terminal 1. For obtaining a maximum attenuation of the resistance value, an extension **4*b* is provided above the electrode 4**.

The slider 9 serves to supply the electric current $i_1$ into the resistance member 7, while the slider 10 acts to take out the voltage through the second terminal.

Therefore, when the electric current $i_1$ of an order of tens of miliamperes is supplied through the contact **9*b* of the slider 9 contacting the resistance member 7, only small electric current flows toward the second terminal 2, in spite of the presence of the contact resistance CR, provided that the input impedance of the circuit connected to the second terminal 2 is sufficiently high. In consequence, the voltage $V_2$ derived from the second terminal 2** involves almost no component of the voltage drift $\Delta CR$ caused by the change in the contact resistance CR. In consequence, the undesirable sliding noise, which is inevitable in the conventional current-controlling use, is eliminated advantageously.

From the foregoing description, it will be seen that, thanks to the improvement in the resistance circuit pattern and the sliding operation of the slider, the unfavourable sliding noise is eliminated almost perfectly, so that the variable resistor of the invention has a stable characteristics suitable for the control of the current output.

Although the invention has been described through a specific embodiment applied to a linear slide type resistor, needless to say, the invention can equally be applied to rotary type resistors.

Other changes and modifications are possible without departing from the spirit or scope of the invention which is limited solely by the appended claims.

What is claimed is:

1. A variable resistor comprising: an insulating substrate; a resistance member formed on said insulating substrate and connected to first and third terminals through respective electrodes; a collector formed on said insulating substrate in parallel with said resistance member and connected at its one end to a second terminal; a conductor formed on said insulating substrate and extending in parallel with said resistance member over the entire length of said resistance member from the electrode connected to one end of said resistance member; and first and second sliders carried by a common slider carrier, said first slider having contacts adapted to slide on said resistance member and said conductor, while said second slider having contacts adapted to slide on said resistance member and said collector at the same position on said resistance member along the length of said resistance member.

2. A variable resistor as claimed in claim 1, wherein said conductor is arranged at the opposite side of said resistance member to said collector.

3. A variable resistor as claimed in claim 1, the electrode connecting the third terminal to said resistance member having a conductive portion adapted to engage said second slider while said first slider still engages said resistance member.

4. In a variable resistor having a resistance member extending between a first and a third terminal adapted to have a voltage applied therebetween, a second terminal being connected to a collector extending along said resistance member and means including a slider having contacts engaging said collector and said resistance member for varying the voltage between said second and third terminals by movement of said slider; the improvement including means electrically connecting the portion of said resistance member engaged with said slider with said first terminal for reducing the flow of current through said slider when said second terminal is connectd to a device having a high input impedance.

5. A variable resistor according to claim 4, said reducing means including a conductor connected electrically with said first terminal and extending along said resistance member, and a second slider movable in unison with the first mentioned slider and having contacts engaging said resistance member and said conductor.

* * * * *